US009766029B2

(12) United States Patent
Dextraze et al.

(10) Patent No.: US 9,766,029 B2
(45) Date of Patent: Sep. 19, 2017

(54) DETACHABLE CHASSIS BASE FOR RIFLE

(75) Inventors: Serge Dextraze, St-Jean-sur-Richelieu (CA); Steven Jones, Petawawa (CA)

(73) Assignee: CADEX, INC., St-Jean-sur-Richelieu (CA)

( * ) Notice: Subject to any disclaimer, the term of this patent is extended or adjusted under 35 U.S.C. 154(b) by 0 days.

(21) Appl. No.: 13/548,154

(22) Filed: Jul. 12, 2012

(65) Prior Publication Data

US 2013/0014418 A1 Jan. 17, 2013

Related U.S. Application Data

(60) Provisional application No. 61/507,119, filed on Jul. 12, 2011.

(51) Int. Cl.
*F41A 11/02* (2006.01)
*F41A 29/00* (2006.01)

(52) U.S. Cl.
CPC ..... *F41A 11/02* (2013.01); *F41A 29/00* (2013.01)

(58) Field of Classification Search
CPC .. F41C 23/16; F41A 11/00; F41A 5/18; F41A 3/26; F41A 3/66
USPC ..... 42/75.01, 75.03, 71.01, 73, 75.02, 16; 89/191.01
See application file for complete search history.

(56) References Cited

U.S. PATENT DOCUMENTS 2,547,180 A 4/1951 Taylor
2,657,489 A * 11/1953 Robertson, Jr. ..... 42/50
2,997,803 A * 8/1961 Florence ..... 42/18
3,206,885 A * 9/1965 Dye ..... 42/75.03
3,562,944 A 2/1971 Wagner et al.
3,830,003 A * 8/1974 Clerke ..... 42/75.03
4,220,071 A * 9/1980 Seiderman ..... 89/128
4,237,638 A * 12/1980 Trexler ..... 42/6
4,515,064 A * 5/1985 Hohrein ..... 89/128
5,173,564 A 12/1992 Hammond, Jr.
5,513,461 A 5/1996 Weldle
5,520,019 A * 5/1996 Schuetz ..... 42/49.02
5,899,013 A * 5/1999 Hauser et al. ..... 42/6
6,250,194 B1 6/2001 Brandl et al.
6,487,805 B1 * 12/2002 Reynolds ..... 42/75.03
6,637,142 B1 * 10/2003 Reynolds ..... 42/75.03
7,131,228 B2 11/2006 Hochstrate et al.
7,451,682 B2 11/2008 Quis
7,574,823 B2 8/2009 Nakayama
D623,718 S * 9/2010 Peterson et al. ..... D22/108
7,793,452 B1 9/2010 Samson et al.
7,802,392 B2 * 9/2010 Peterson et al. ..... 42/75.03
7,905,041 B1 3/2011 Davies
(Continued)

FOREIGN PATENT DOCUMENTS

GB 2026659 A 2/1980

*Primary Examiner* — Joshua Freeman
(74) *Attorney, Agent, or Firm* — FisherBroyles, LLP; Anthony J. DoVale

(57) ABSTRACT

A detachable chassis base for a tactical rifle is presented. The lower chassis receiver assembly can have a detachable chassis base that substantially selectively attaches to the chassis receiver interface. The detachable chassis base can be completely removable, or it can be hingedly attached to provide access without completely removing the chassis base, or a combination thereof. Multiple combinations of parts included in the detachable chassis base are possible. Several variations and combinations are illustrated herein, although others are contemplated.

23 Claims, 18 Drawing Sheets

(56) References Cited

U.S. PATENT DOCUMENTS

| | | | | |
|---|---|---|---|---|
| 7,926,217 | B2 | 4/2011 | McCann | |
| 7,938,055 | B2 | 5/2011 | Hochstrate et al. | |
| 7,941,958 | B1 | 5/2011 | Zedrosser | |
| 7,941,959 | B1 | 5/2011 | Swan | |
| D640,766 | S * | 6/2011 | Joplin | D22/108 |
| 8,015,740 | B2 * | 9/2011 | Jamison et al. | 42/69.02 |
| 8,397,417 | B2 * | 3/2013 | Jamison | 42/75.03 |
| 8,418,390 | B1 * | 4/2013 | Wright | 42/49.01 |
| 8,434,253 | B2 * | 5/2013 | Cain et al. | 42/6 |
| 2009/0019755 | A1 | 1/2009 | Moretti | |
| 2009/0277066 | A1 | 11/2009 | Burt et al. | |
| 2009/0288324 | A1 * | 11/2009 | Peterson et al. | 42/75.03 |
| 2010/0037504 | A1 * | 2/2010 | Muller | 42/90 |
| 2011/0094136 | A1 | 4/2011 | Zimmermann | |
| 2011/0099868 | A1 | 5/2011 | Lammers | |
| 2011/0185618 | A1 * | 8/2011 | Jamison et al. | 42/75.03 |
| 2012/0073177 | A1 * | 3/2012 | Laney et al. | 42/16 |
| 2012/0180360 | A1 * | 7/2012 | Jones | 42/75.03 |

* cited by examiner

DETACHABLE CHASSIS BASE FOR RIFLE

CONTINUITY DATA

This application claims priority to and the benefit of U.S. Provisional Patent Application No. 61/507,119, filed on Jul. 12, 2011, which is incorporated herein in its entirety.

FIELD OF THE INVENTION

This invention relates generally to firearms, and more particularly to a chassis for use with rifles.

BACKGROUND OF THE INVENTION

In military and law enforcement terminology, a sniper rifle is a precision-rifle used to ensure more accurate placement of bullets at longer ranges than other small arms. A typical sniper rifle is built for optimal levels of accuracy and fitted with a telescopic sight. Advances in technology, specifically that of telescopic sights and more accurate manufacturing, allowed armies to equip specially-trained soldiers with rifles that enable them to deliver precise shots over greater distances than regular infantry weapons. The rifle itself could be based on a standard rifle (at first, a bolt-action rifle); however, when fitted with a telescopic sight, it becomes a sniper rifle.

As one can imagine, the maintenance of a sniper rifle can be of utmost importance to its user. As such, access to components in an expeditious and efficient manner is vital.

SUMMARY

Presented herein is a detachable chassis base for a tactical rifle. In one aspect, the rifle is a bolt action rifle; however, other rifle types are contemplated. The rifle comprises a trigger mechanism, chassis receiver, stock, grip, barrel, and magazine well. In one aspect, the stock is foldable. In another aspect, the stock remains in a fixed position.

In one aspect, the lower chassis receiver assembly comprises a detachable chassis base that substantially selectively attaches to the chassis receiver interface. In this aspect, the detachable chassis base comprises a flared magazine well assembly, magazine catch, and trigger guard. The detachable chassis base can be attached to the chassis receiver interface with fasteners 150, such as but not limited to, mounting screws. In this aspect, when the detachable chassis base is removed from the full chassis receiver assembly, the trigger mechanism is revealed, permitting maintenance of the trigger mechanism and surrounding area without removal of the same.

The detachable chassis base can be completely removable, or it can be hingedly attached to provide access without completely removing the chassis base, or a combination thereof. Multiple combinations of parts included in the detachable chassis base are possible. Several variations and combinations are illustrated herein, although others are contemplated.

Related methods of operation are also provided. Other apparatuses, methods, systems, features, and advantages of the dispensing apparatus will be or become apparent to one with skill in the art upon examination of the following figures and detailed description. It is intended that all such additional apparatuses, methods, systems, features, and advantages be included within this description, be within the scope of the detachable chassis base, and be protected by the accompanying claims.

DESCRIPTION OF THE FIGURES

The accompanying drawings, which are incorporated in and constitute a part of this specification, illustrate certain aspects of the instant invention and together with the description, serve to explain, without limitation, the principles of the invention. Like reference characters used therein indicate like parts throughout the several drawings.

DESCRIPTION OF THE INVENTION

Figure 1:
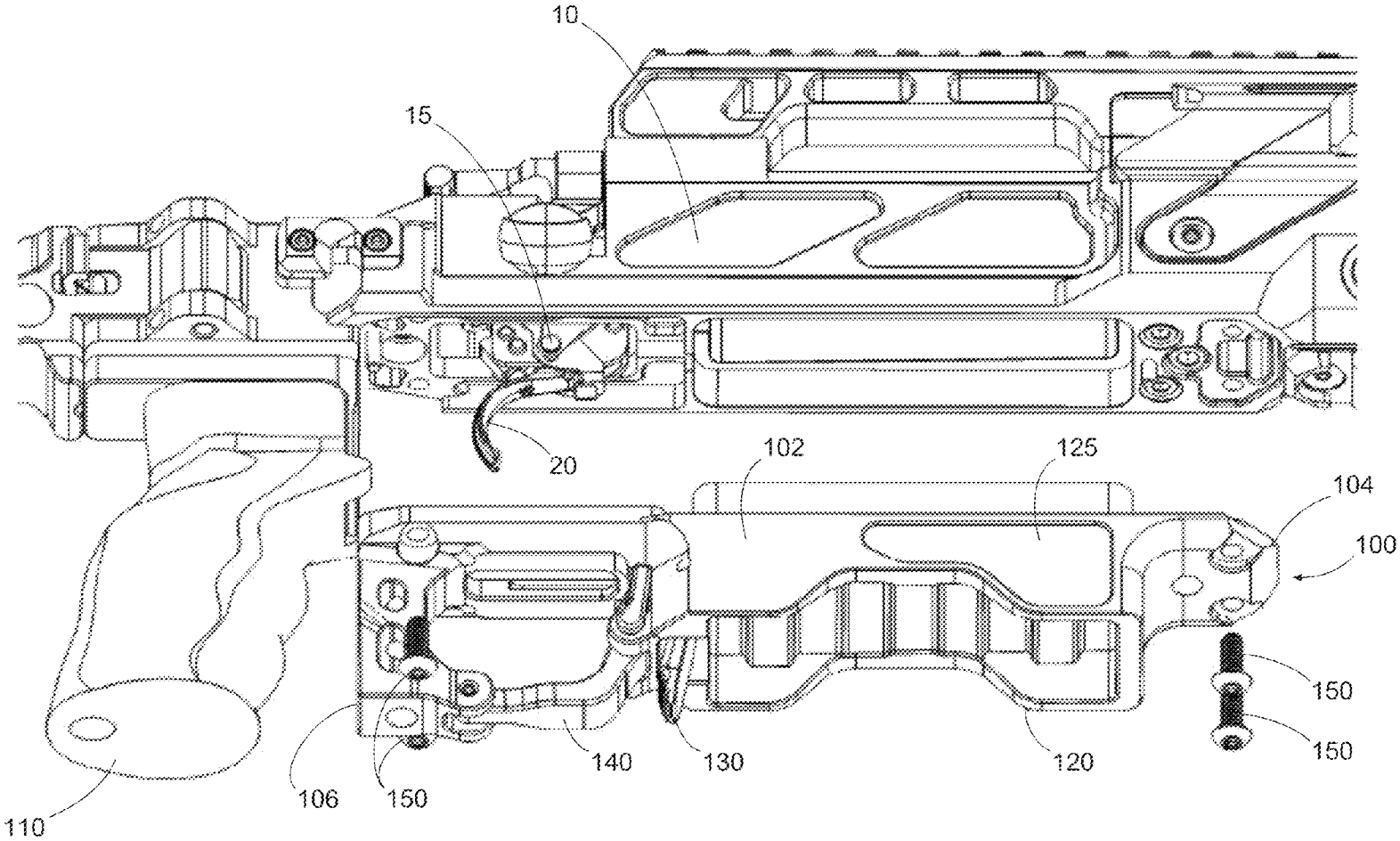
FIG. 1 is a partially exploded perspective view of one aspect of a detachable chassis base for a firearm as presented herein.

The present invention can be understood more readily by reference to the following detailed description, examples, and claims, and their previous and following description. Before the present system, devices, and/or methods are disclosed and described, it is to be understood that this invention is not limited to the specific systems, devices, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. Those skilled in the relevant art will recognize that many changes can be made to the aspects described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "rail" includes aspects having two or more rails unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Presented herein is detachable chassis base 100 for a tactical rifle. In one aspect, the rifle is a bolt action rifle; however, other rifle types are contemplated. The rifle comprises a trigger mechanism 15 connected to the trigger 20, chassis receiver 10, stock (not shown), grip 110, barrel, and magazine well 120. In one aspect, the stock is foldable. In another aspect, the stock remains in a fixed position.

In one aspect, as illustrated in FIG. 1, the chassis receiver 10 assembly comprises a detachable chassis base 100 that substantially selectively attaches to the chassis receiver interface. In this aspect, the detachable chassis base comprises a flared magazine well assembly, magazine catch 130, and trigger guard 140. The detachable chassis base can be attached to the chassis receiver 10 with fasteners 150, such as but not limited to, mounting screws. In this aspect, when the detachable chassis base 100 is removed from the full chassis receiver assembly, the trigger mechanism 15 is revealed, permitting maintenance of the trigger mechanism and surrounding area without removal of the same.

In another aspect, the pistol grip interface can be of the AR15 type, which provides the user a wide selection of grips to achieve comfort and proper hand position for beneficial trigger manipulation.

In an exemplified aspect, the magazine well 120 of the detachable chassis base can incorporate cut-outs on each side to allow extra space for the shooter's hand when inserting/removing the magazine. In this aspect, the sides 125 of the magazine well comprise a low profile such that magazine changes have adequate clearance when the shooter is in a low prone position. It is contemplated that the magazine well may be constructed of any suitable material, such as for example and not meant to be limiting, aluminum or composite material. However, in one aspect, the magazine well 120 comprises Delrin material, which is light weight, and extremely strong. Delrin has a low surface friction characteristic which assists with insertion and removal of magazines.

In this aspect, the magazine catch 130 can be located between the magazine well and the trigger guard 140. The trigger guard can be profiled in a manner that clearance is provided so the shooter's thumb or finger can easily access the magazine catch.

As one skilled in the art can appreciate, the process to remove a barreled action from chassis systems is normally lengthy and requires removal of main optic and top rail, thus disturbing the established zero of the weapon and optics. This degree of disassembly is not maintenance friendly; upon reassembly the sniper must re-establish zero of the weapon and optics requiring time, a location to shoot to verify zero, and the expenditure of ammunition. Additionally, removal of the barreled action from chassis imposes bedding or the metal bedding interface to unnecessary wear and the possibility of damage which can adversely affect the accuracy of the firearm.

The detachable chassis base, as described herein, mitigates these issues and provides easier maintainability of the sniper system. Additionally, access to the trigger mechanism for cleaning and trigger mechanism 15 adjustment are possible without removing the barreled action from the chassis.

The detachable chassis base 100 presented herein considers the wide variety of makes and designs of trigger mechanisms available on the market. The location of adjustment screws vary significantly with each design. Adjustment screws located on the front and rear of the trigger mechanism of the Allen head type are accessible by removal of the detachable chassis base. On other trigger mechanism types, adjusting screws are accessed from the bottom, removal of the trigger guard 140 provides this access.

In this aspect, armorers can torque action screws with detachable base installed or removed from chassis. Access holes for the action screws are located in the detachable chassis base 100. Normally, cleaning or lubricating the inside of the chassis receiver via the ejection opening is difficult due to the small size of the opening. Removal of the detachable chassis base allows access to the inside of the chassis receiver 10 from the bottom, providing easier access to the receiver for cleaning.

In still another aspect, the detachable chassis base can make the chassis modular, thus allowing the use of various calibers, magazine types, and magazine dimensions. Different lengths and widths of magazine well opening can be manufactured to accommodate magazines for different calibers and lengths of cartridge. This includes different magazine capacities (i.e. single stack-5 round magazines, or double stack-10 round magazines). In service this provides end users commonality of training and logistics, having the same chassis, only changing the detachable base 100.

In this exemplified aspect, the modular magazine well allows easy incorporation of different types of magazine catches without redesign of the entire chassis. This accommodates varieties of magazines that end users have in service, and considers future growth for next generation magazines. It also allows integration of different manufacturer's barreled actions into the chassis system; to consider different cartridge feed angles to ensure reliable cartridge feeding.

One of the benefits of this aspect include that in-service sniper systems can employ different type or dimension magazines by interchanging the detachable chassis base, while maintaining commonality of substantially the remainder of the chassis system components. Operationally, this provides commonality of the chassis platform as a mounting system for electro-optics, enabling use of the same weapon operating procedures across a sniper fleet. Logistically, this allows wide range use of the same repair parts and maintenance procedures to support the sniper fleet.

Another benefit of this aspect of the system is that modularity of the detachable chassis base provides room for design growth, such as but not limited to, incorporating longer magazines that result from new ammunition developments. Typically new sniper cartridges employ Very Low Drag (VLD) projectiles that are longer and, in many instances, cause the cartridge overall length to increase beyond the standard design length (SAAMI or CIP). This requires that a longer magazine box be used.

Figure 2:
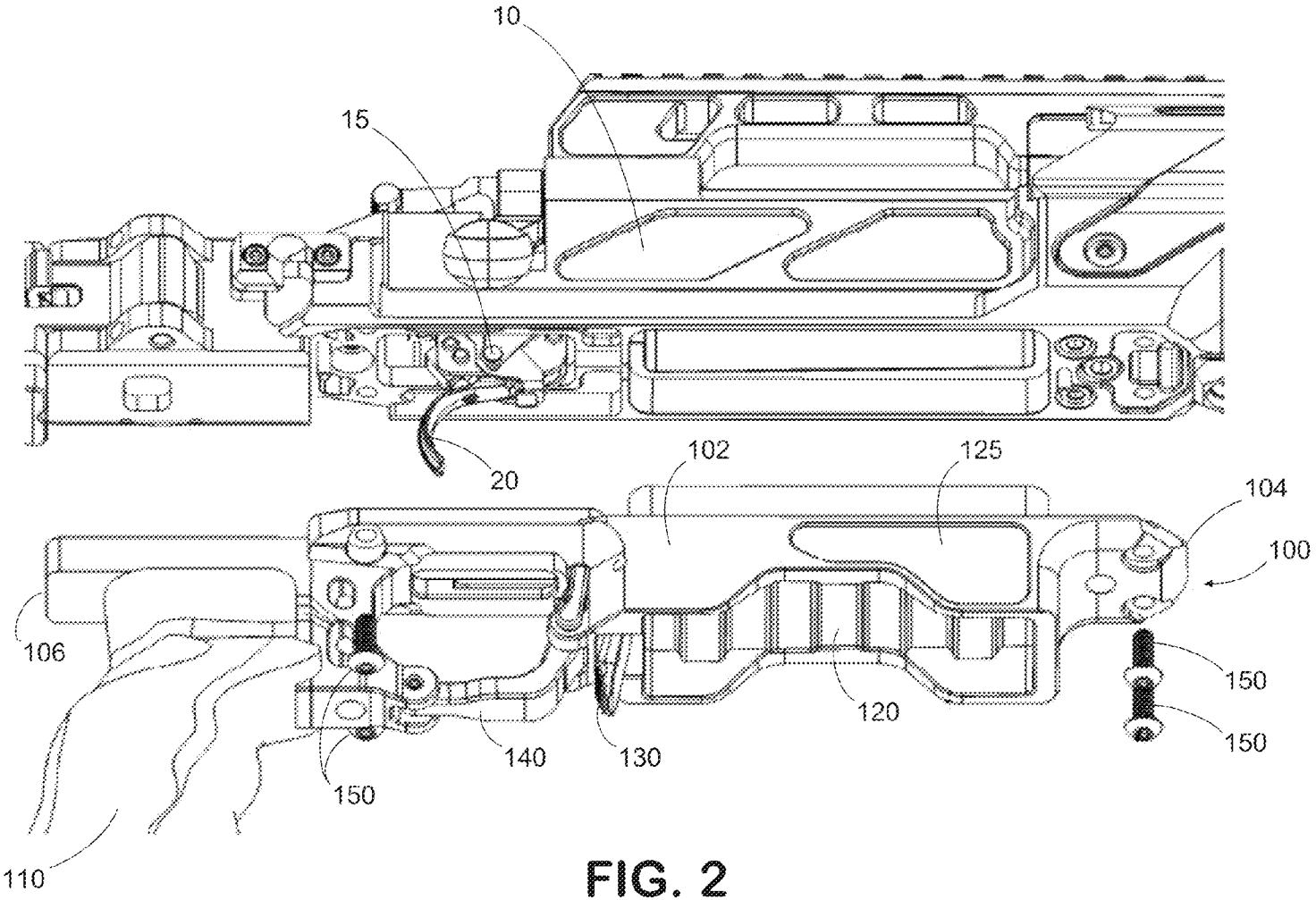
FIG. 2 is a partially exploded perspective view of one aspect of a detachable chassis base for a firearm where a pistol grip is attached to the chassis base.

In another aspect, as illustrated in FIG. 2, the detachable chassis base 100 comprises a pistol grip mount, trigger guard 140 and magazine well 120. While the pistol grip 110, trigger guard, and magazine well can be integral, it is also contemplated that the modularity can be extended such that they can be removed together, but also be taken apart.

Figure 3:
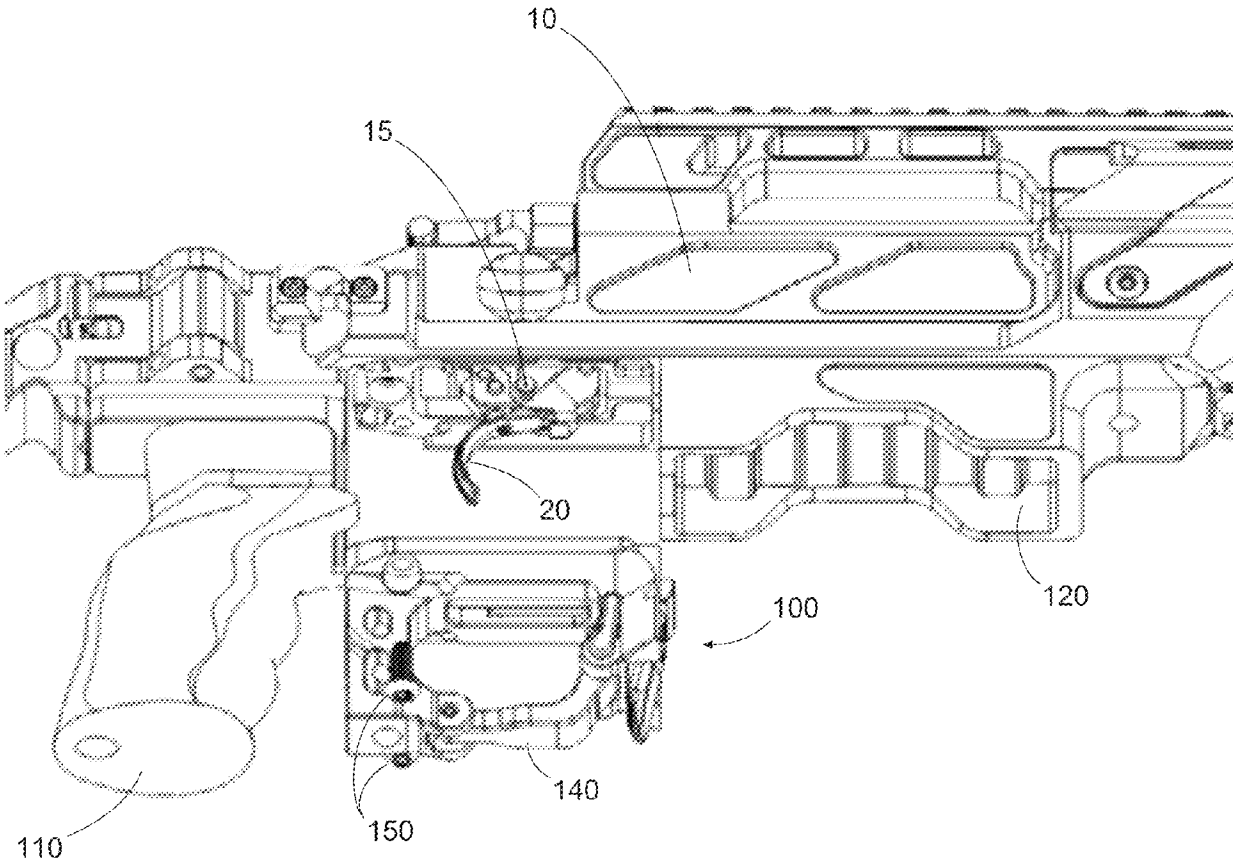
FIG. 3 is a partially exploded perspective view of one aspect of a detachable chassis base for a firearm with a separately removable trigger guard.

In still another aspect, as illustrated in FIG. 3, the pistol grip and the magazine well can be attached to the chassis receiver, while the trigger guard can be removable by itself. This aspect still permits cleaning of the trigger 20 and adjustment thereto. In yet another aspect, the detachable chassis base can comprise at least two separate pieces; the trigger guard and magazine catch 130, and the magazine well.

Figure 4:
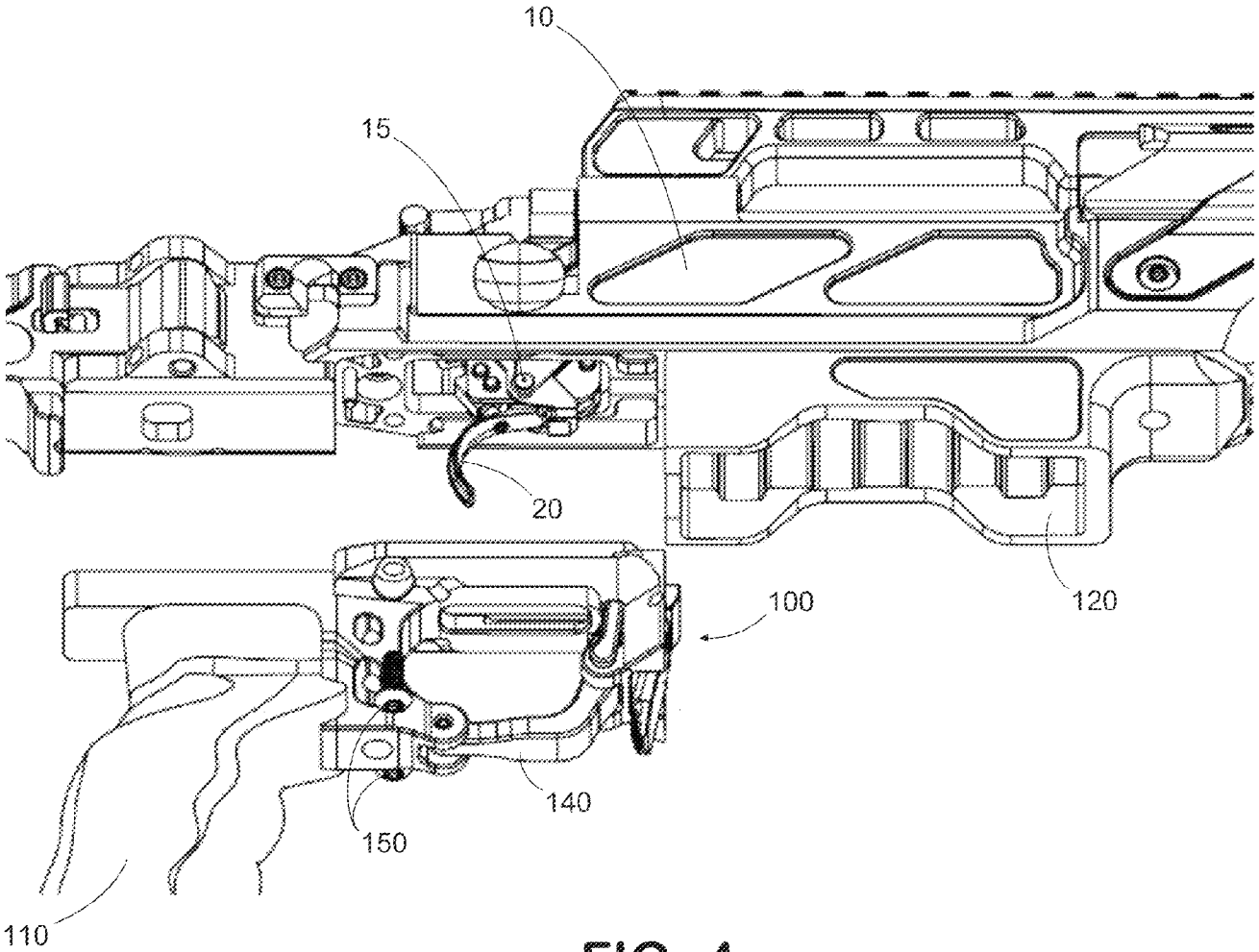
FIG. 4 is a partially exploded perspective view of one aspect of a detachable chassis base for a firearm where the trigger guard and pistol grip are integral.

In one aspect, as illustrated in FIG. 4, the pistol grip 110 can be attached to the trigger guard assembly. In this aspect, the detachable chassis base comprises the pistol grip mount and the trigger guard assembly. In a similar aspect, the magazine well 120 can also be removable as a separate component. In this aspect, the detachable chassis base 100 comprises the pistol grip mount, trigger guard 140, and magazine well. The removable magazine well as a separate component allows good access to the front of the trigger mechanism 15 for adjustment and cleaning.

Figure 5:
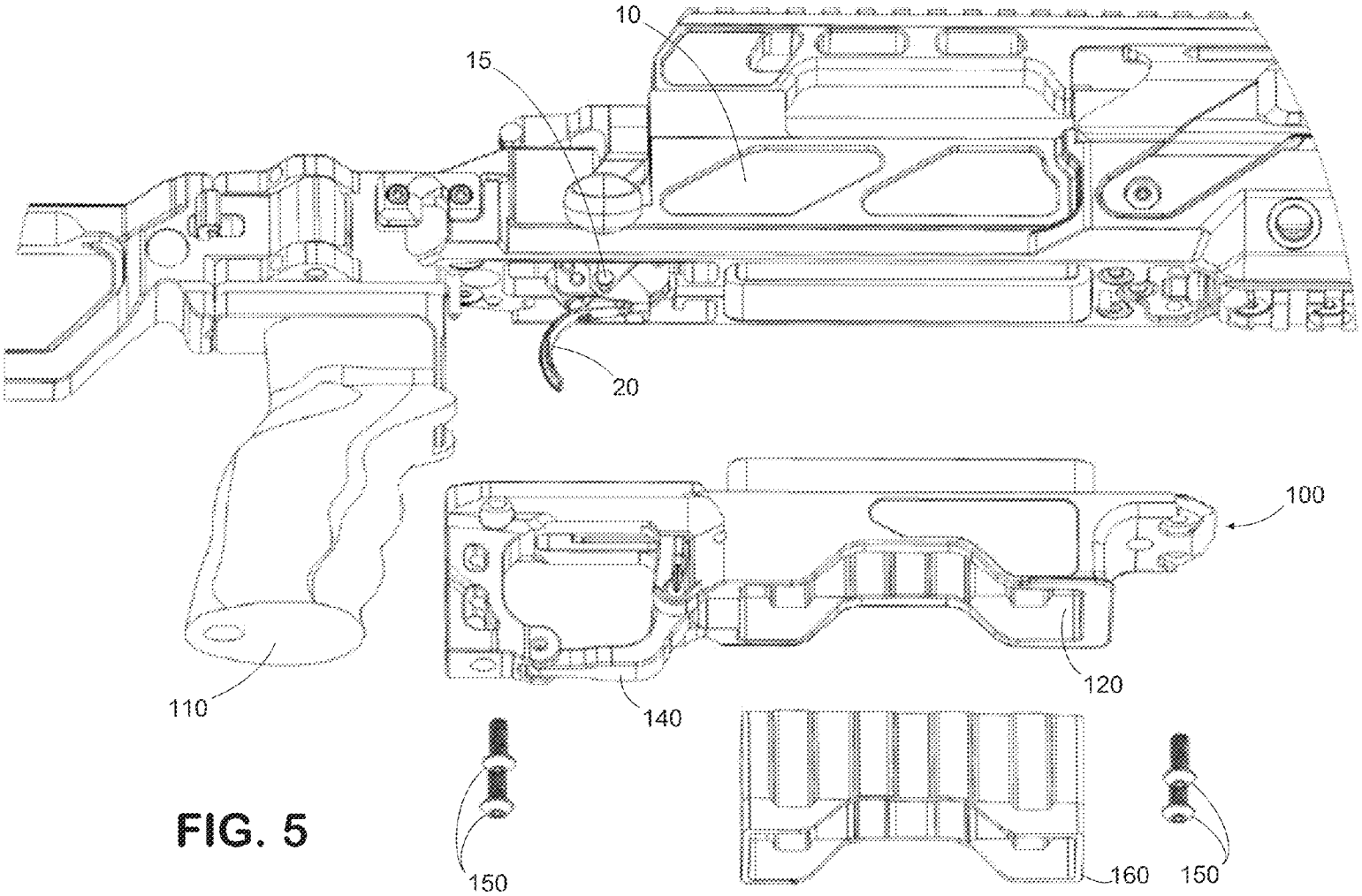
FIG. 5 is a partially exploded perspective view of one aspect of a detachable chassis base for a firearm with an integral trigger guard and magazine well.

In one exemplified aspect, as shown in FIG. 5, the pistol grip 110 can be attached to the chassis receiver 10. Here, the detachable chassis base comprises the trigger guard and a magazine well 120 with an adaptor sleeve 160 for magazines of different sizes. As can be appreciated, this provides good access to the front and rear of the trigger mechanism for performing adjustments and cleaning, as well as good access to the full chassis receiver for cleaning.

Figure 6:
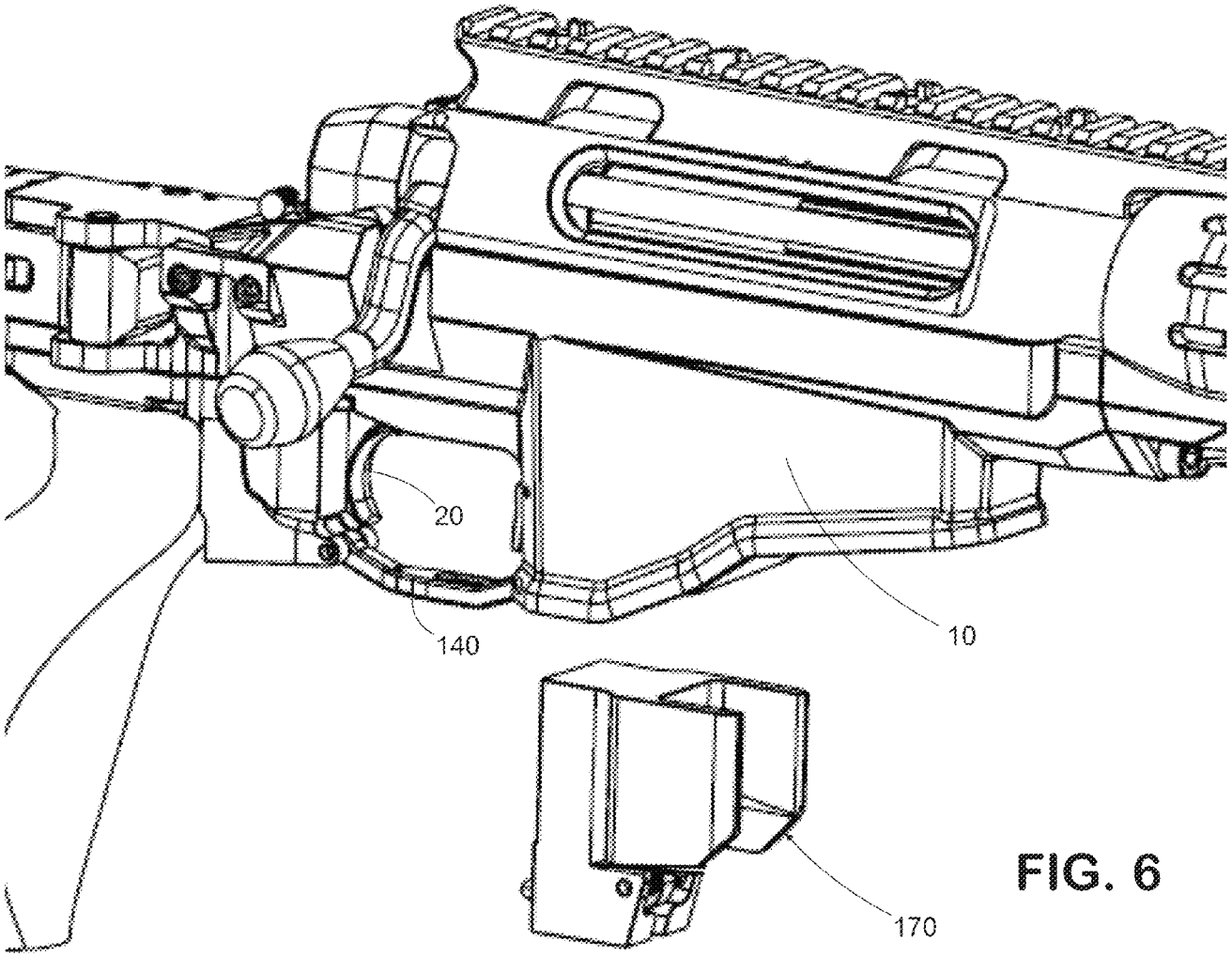
FIG. 6 is a partially exploded perspective view of one aspect of a detachable chassis base for a firearm, showing a magazine adapter block.

FIG. 6 illustrates and aspect with a magazine adaptor block 170. The adaptor block 170 can be used in conjunction with a detachable chassis base to provide a method of changing the magazine well size to accommodate alternate types/dimensions of the magazines.

Figure 7:
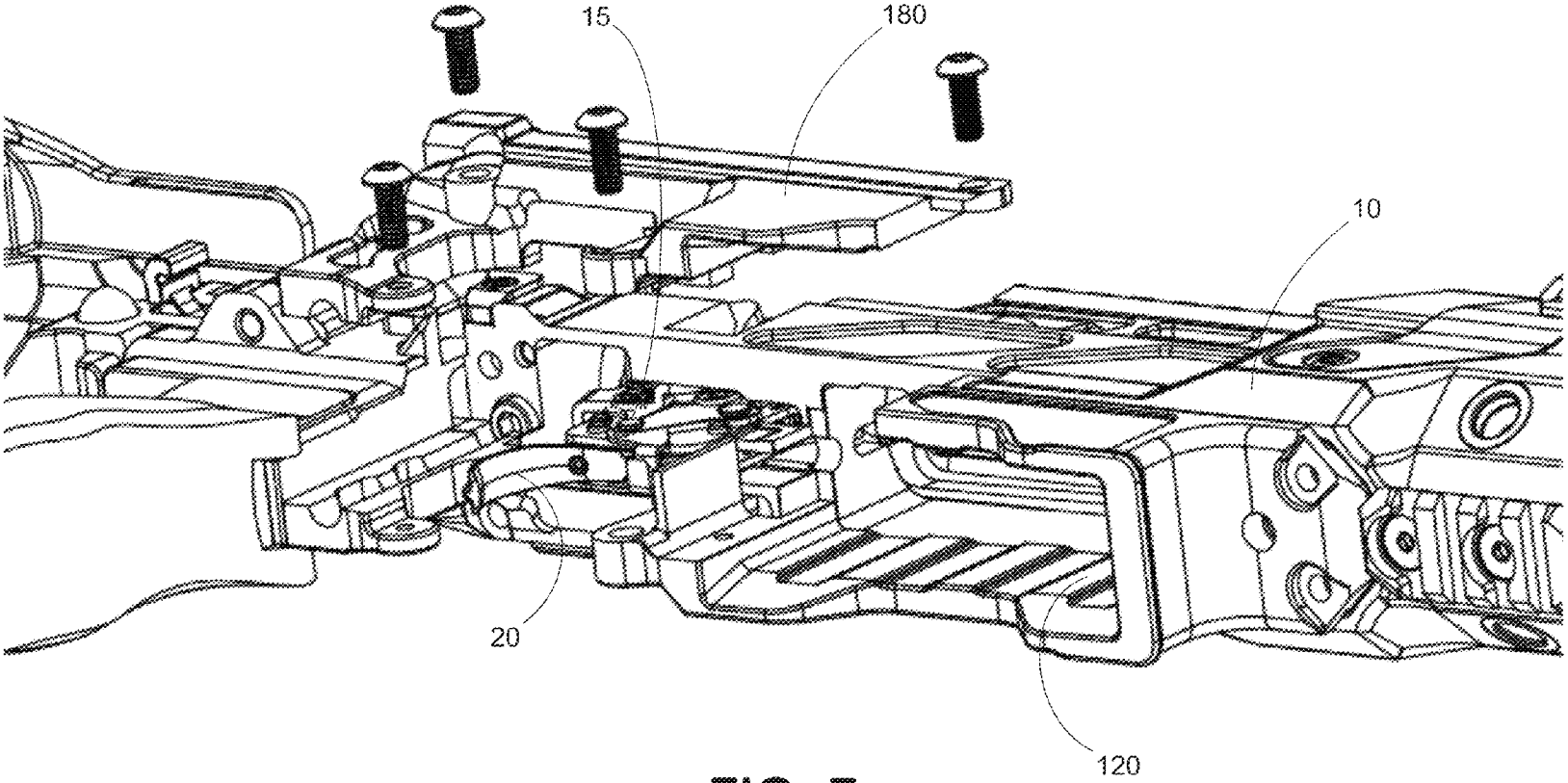
FIG. 7 is a partially exploded perspective view of one aspect of a detachable chassis base for a firearm, showing the detachable chassis base removable from the side.

In one aspect, as shown in FIG. 7, a side portion 180 of the chassis base is removable to gain access to the trigger mechanism 15 for cleaning and maintenance. A detachable base side is secured to the chassis receiver assembly. In this aspect, to gain access, the user can unscrew a bolt and remove the chassis base side 180. FIG. 7 shows a right side method, but it is also contemplated to have a left side method or both sides with detachable chassis base components. The detachable chassis base sides can also be extended to the magazine area and can be replaced to accept other types/dimensions of the magazine.

Figure 8A:
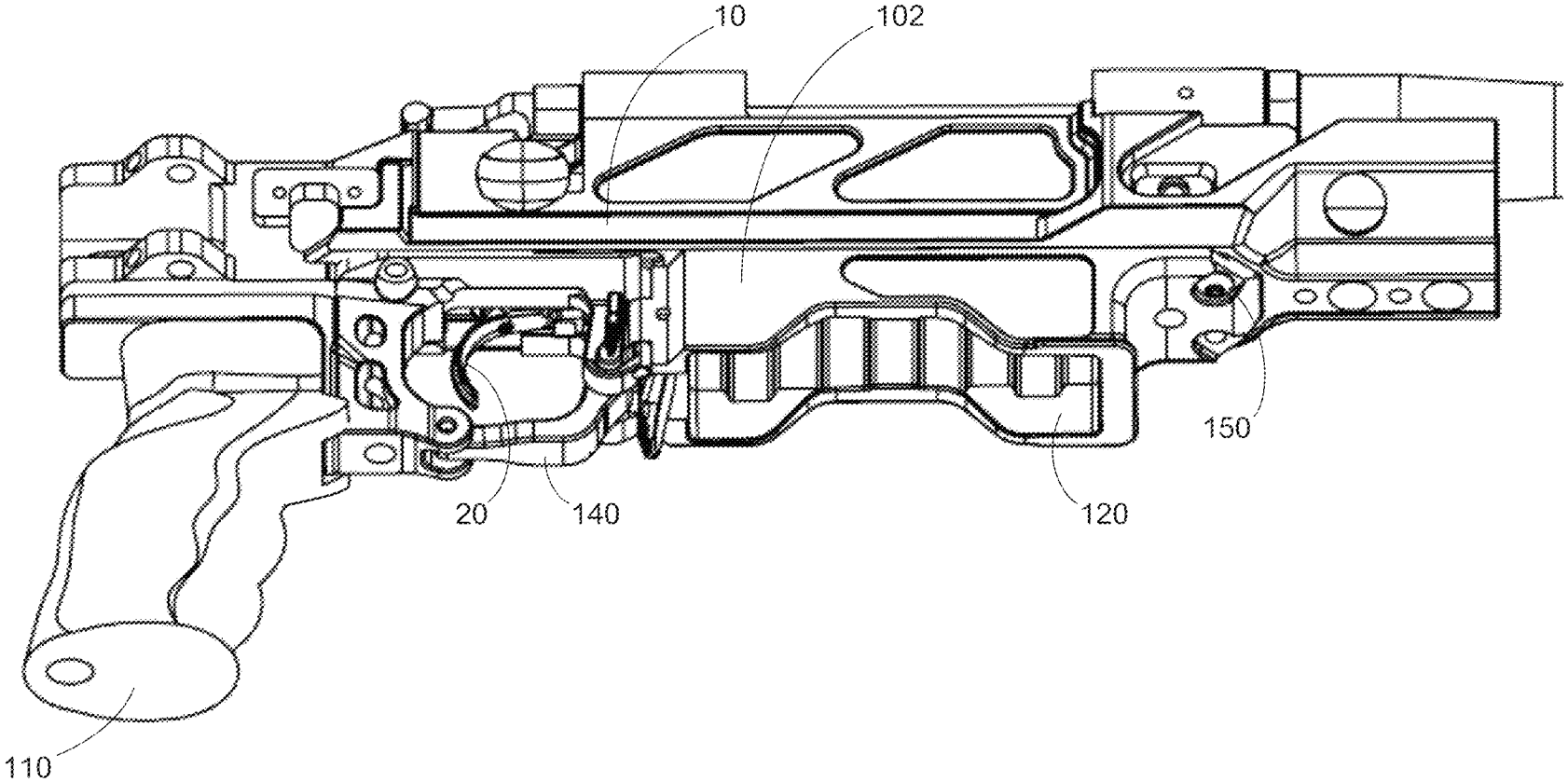
FIGS. 8A and 8B are perspective views of one aspect of a detachable chassis base for a firearm, showing a pivotable trigger guard assembly in the closed (8A) and open (8B) positions.
Figure 8B:
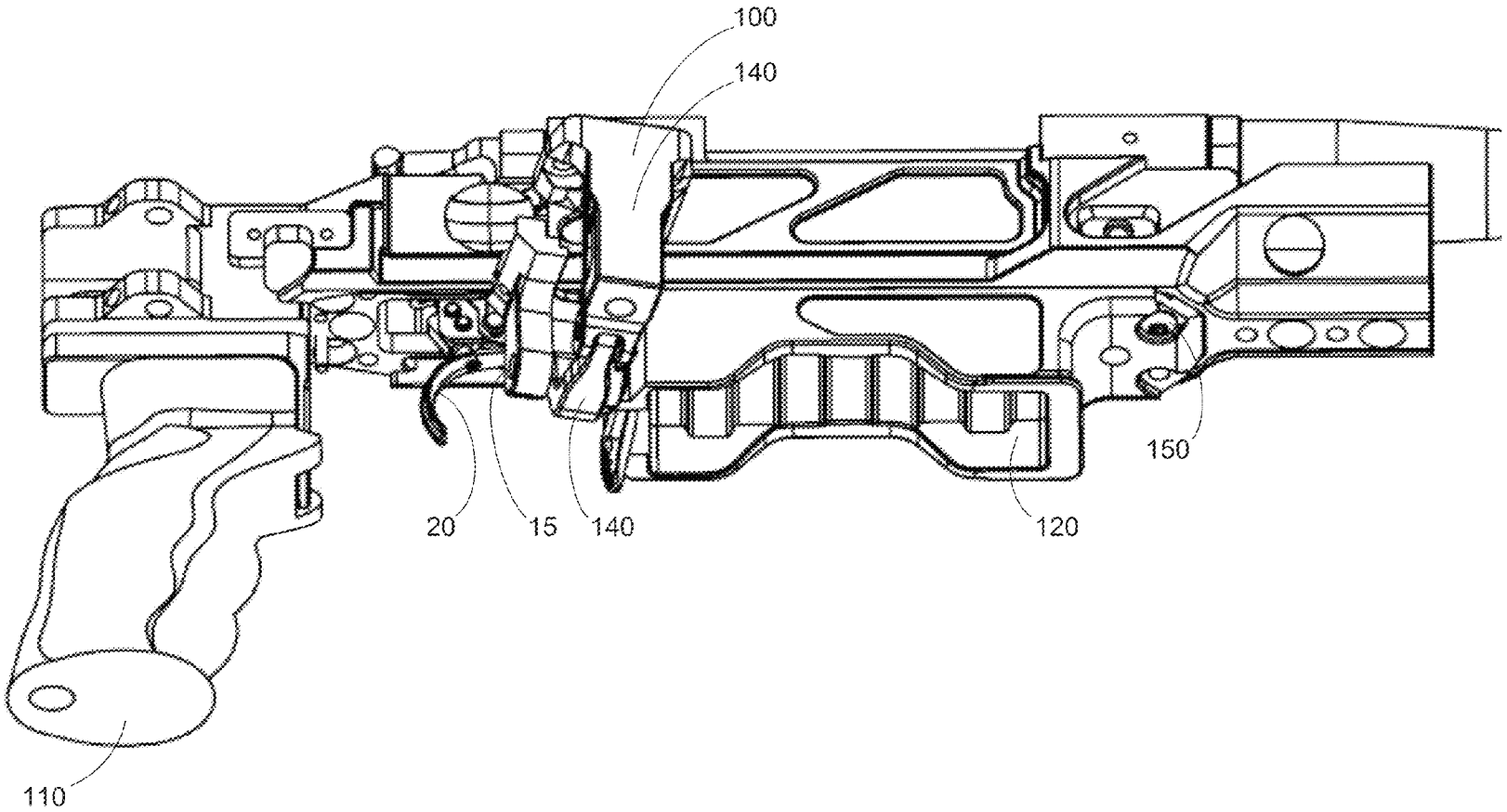

The detachable chassis base 100 can be completely removable, as shown in FIGS. 1-7, or it can be hingedly attached to provide access without completely removing the chassis base, or a combination thereof. In one aspect, as illustrated in FIGS. 8A and 8B, the chassis base comprises a side pivoting trigger guard assembly connected to the detachable chassis base. In this aspect, the chassis base is detachable as in the first 4 figures, with the addition of a side pivoting trigger guard assembly. This allows access to the trigger mechanism for cleaning and/or maintenance without requiring removal of the detachable chassis base 100. In this aspect, the detachable chassis base is removable for purposes of accommodating other magazines as in the first 4 figures. As one skilled in the art can appreciate, while the figures show the trigger guard pivoting to the right, it is also contemplated that it can pivot to the left.

Figure 9A:
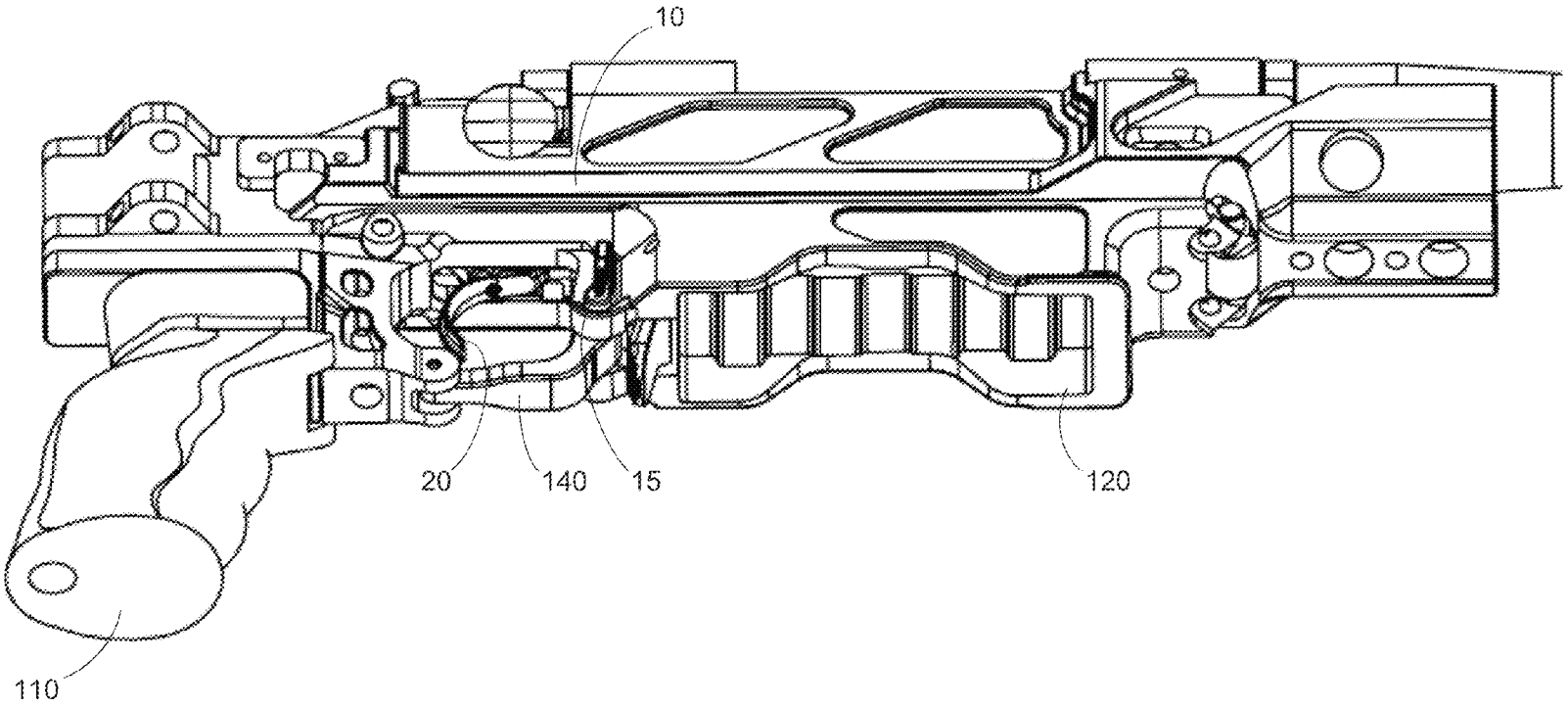
FIGS. 9A, 9B, 9C, and 9D are perspective views of one aspect of a detachable chassis base for a firearm, showing a pivotable chassis base in the closed (9A) and open (9B, 9C, and 9D) positions.
Figure 9B:
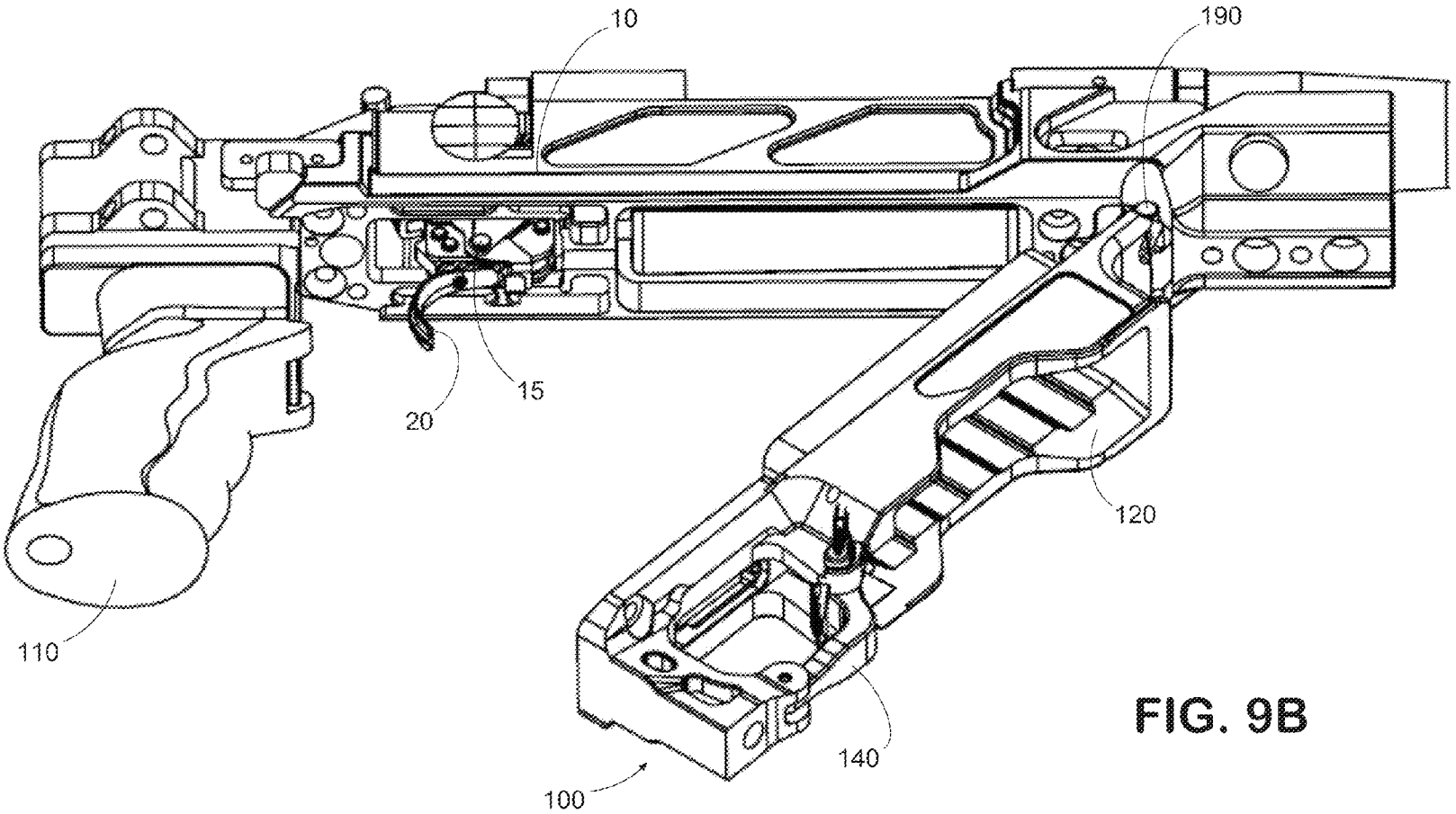
Figure 9C:
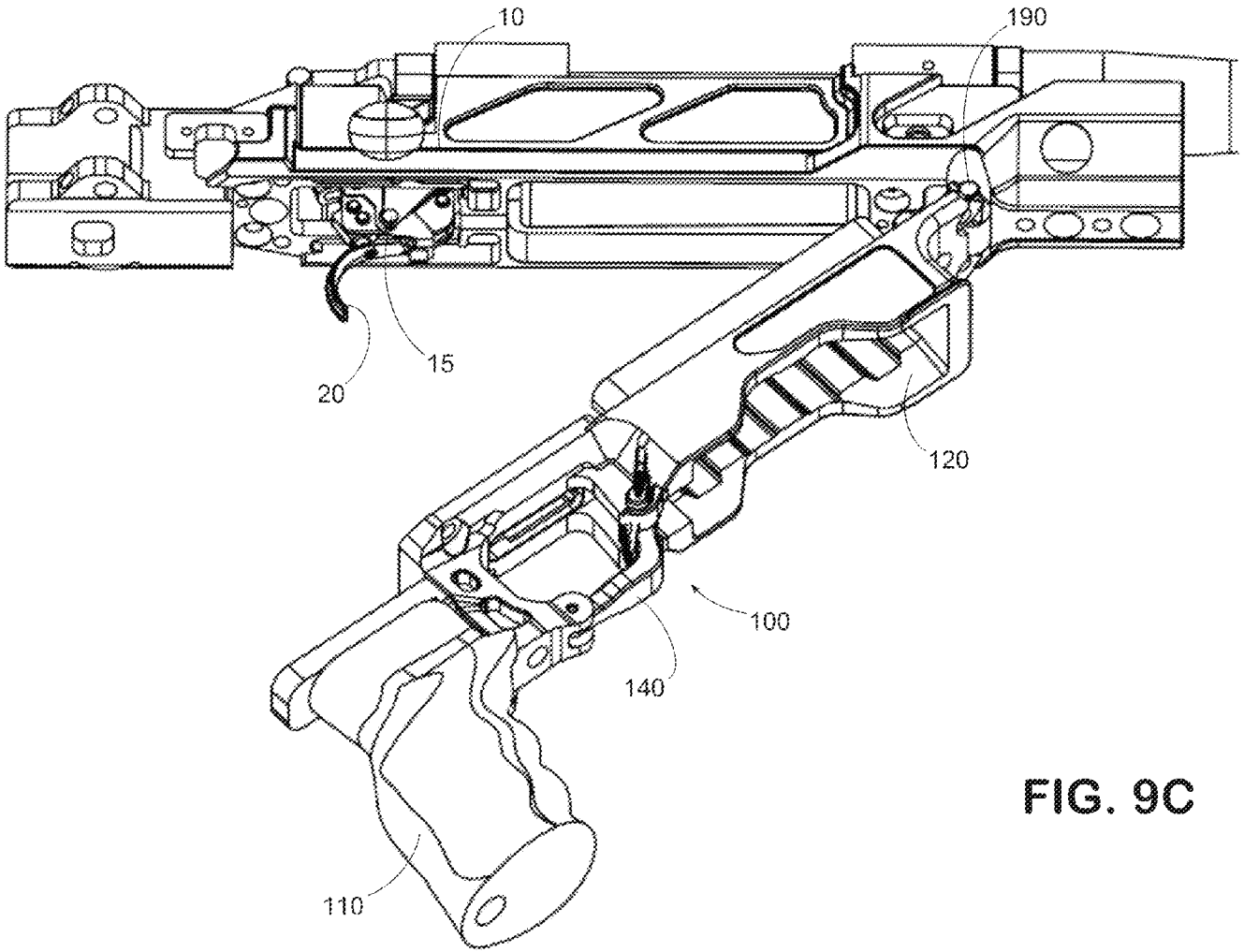
Figure 9D:
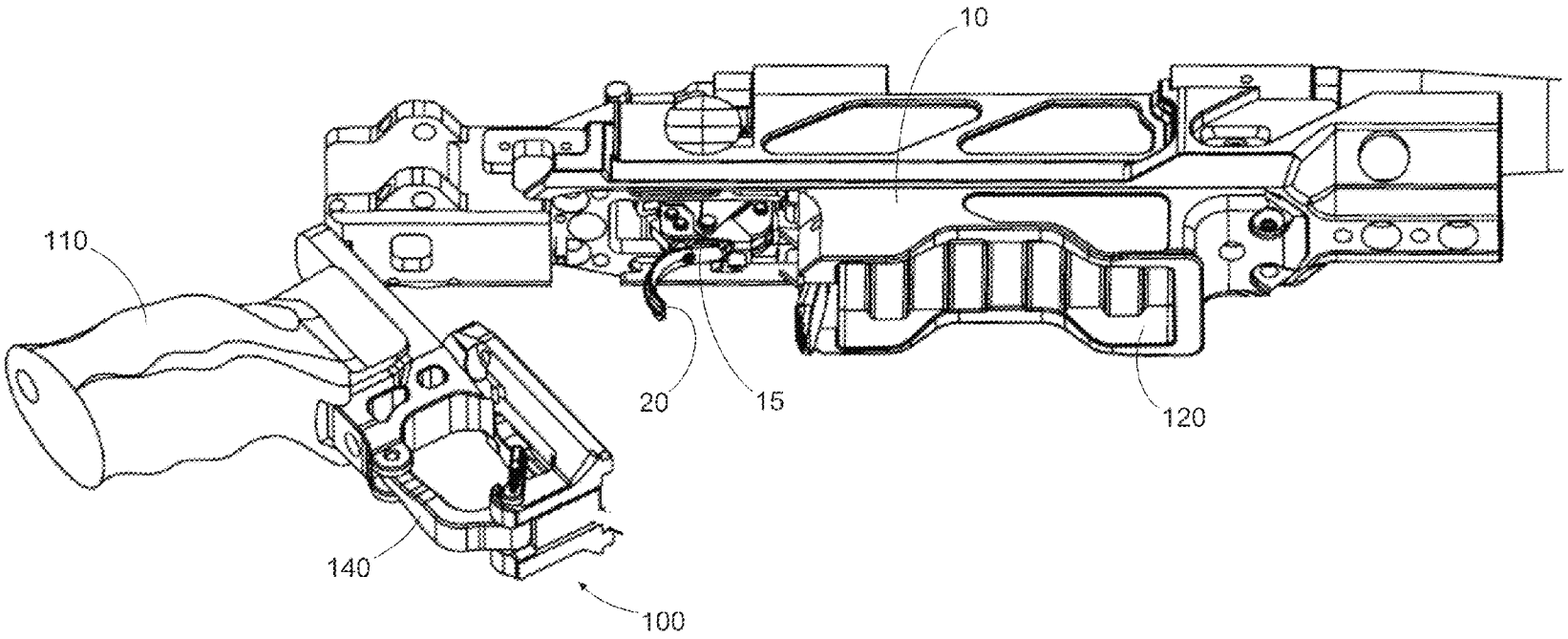

In another aspect, part of or the entire detachable chassis base can be hingedly connected to the chassis receiver 10, as illustrated in FIGS. 9A, 9B, 9C, 9D. In this aspect, the detachable chassis base can be attached by a pivot pin 190. The pivoting motion would occur along the pivot axis A. As such, access to the trigger mechanism for cleaning and/or maintenance is gained by pivoting the detachable chassis base 100, which can further be removable in order to change it to accommodate different size or types of magazines. In still another aspect, the front pivoting detachable chassis base can incorporate a mounting for the pistol grip, as illustrated in FIG. 9C. In another exemplified aspect, the pivoting and attachment of the detachable chassis base can be achieved by use of a rearward pivot point. As such, the pivot pin 190 can be placed on either longitudinal side 102 or at the front 104 or rear 106 end of the detachable chassis. FIG. 9D shows one example, whereby the trigger guard pivots for access to the trigger mechanism 15 for cleaning and/or maintenance. Alternately, the trigger guard and magazine well can be a one-piece assembly, as in FIG. 9B.

Figure 10A:
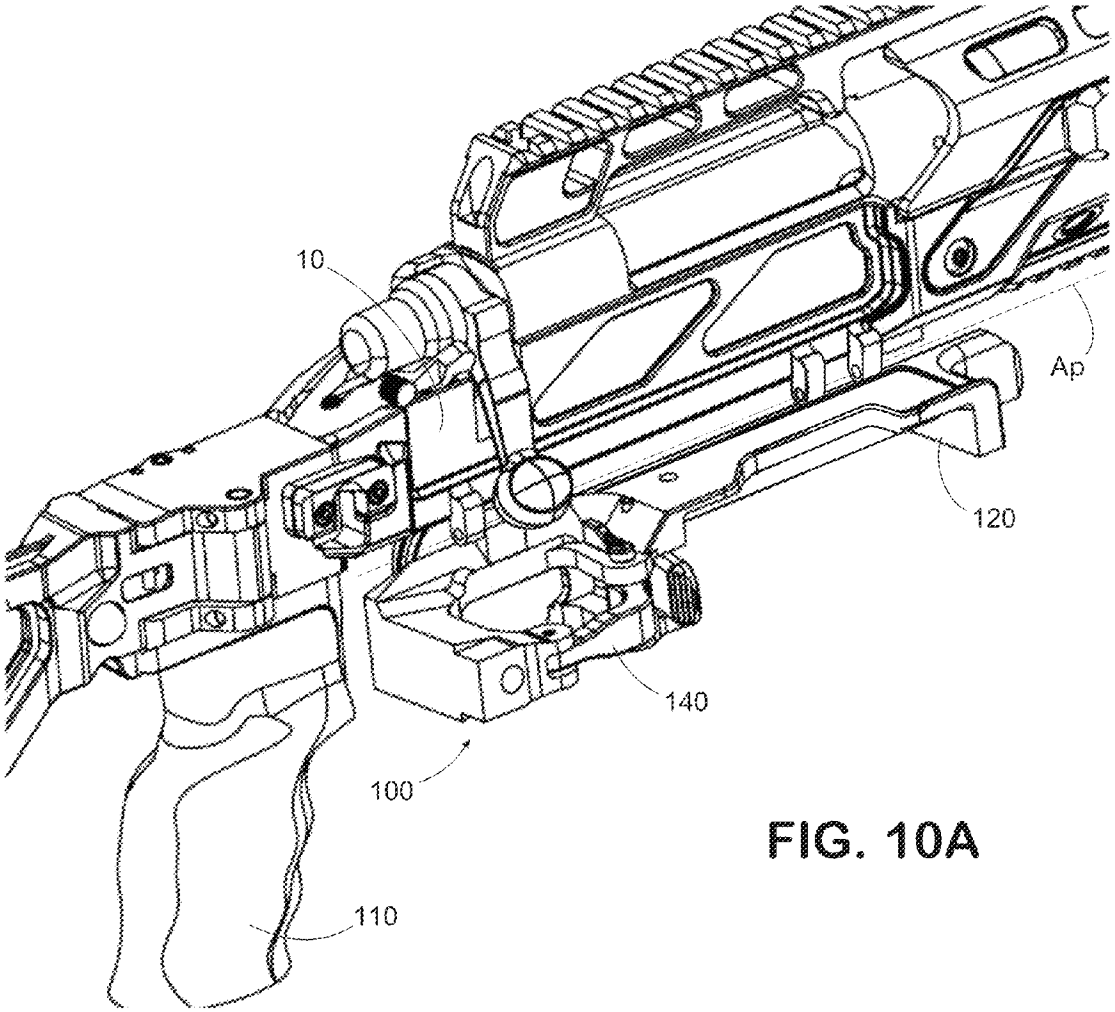
FIGS. 10A and 10B are perspective views of one aspect of a detachable chassis base for a firearm, showing a side pivotable chassis base in the closed (10A) and open (10B) positions.
Figure 10B:
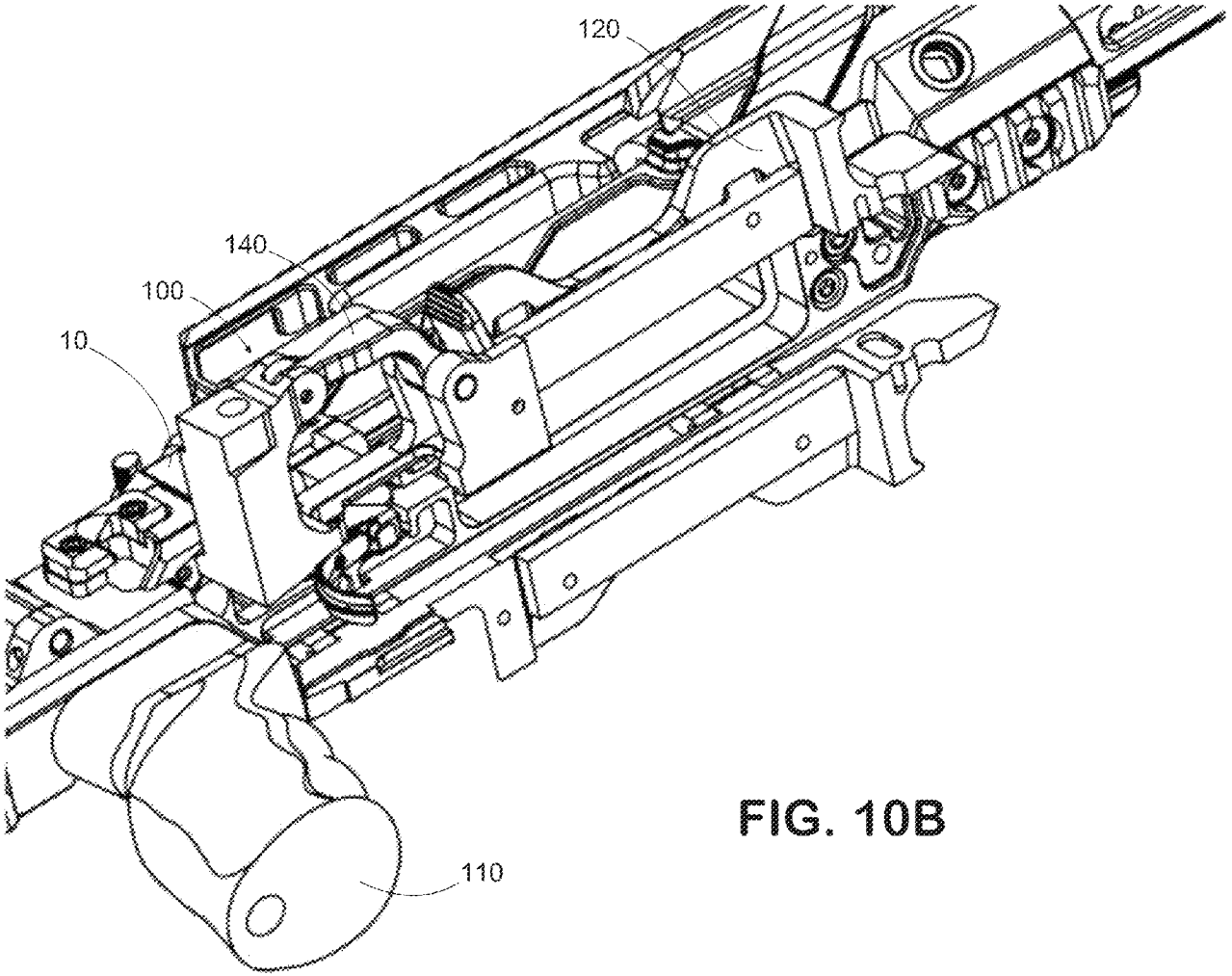

FIGS. 10A and 10B illustrate one aspect of the detachable chassis base pivoting to the side to provide access to the trigger mechanism for cleaning and/or maintenance. In this aspect, the trigger guard 140 and magazine well 120 are part of the detachable chassis base component that pivots to the side. The opposite side of the detachable chassis base comprises the opposite side of the magazine well. Further, in this aspect, pivoting both sides open provides bottom access to the chassis receiver for cleaning. Accommodating alternate size or types of magazines can be accomplished by use of a sleeve insert, as shown in FIG. 5, or by exchanging the left and right detachable chassis base assemblies, for example.

Figure 11:
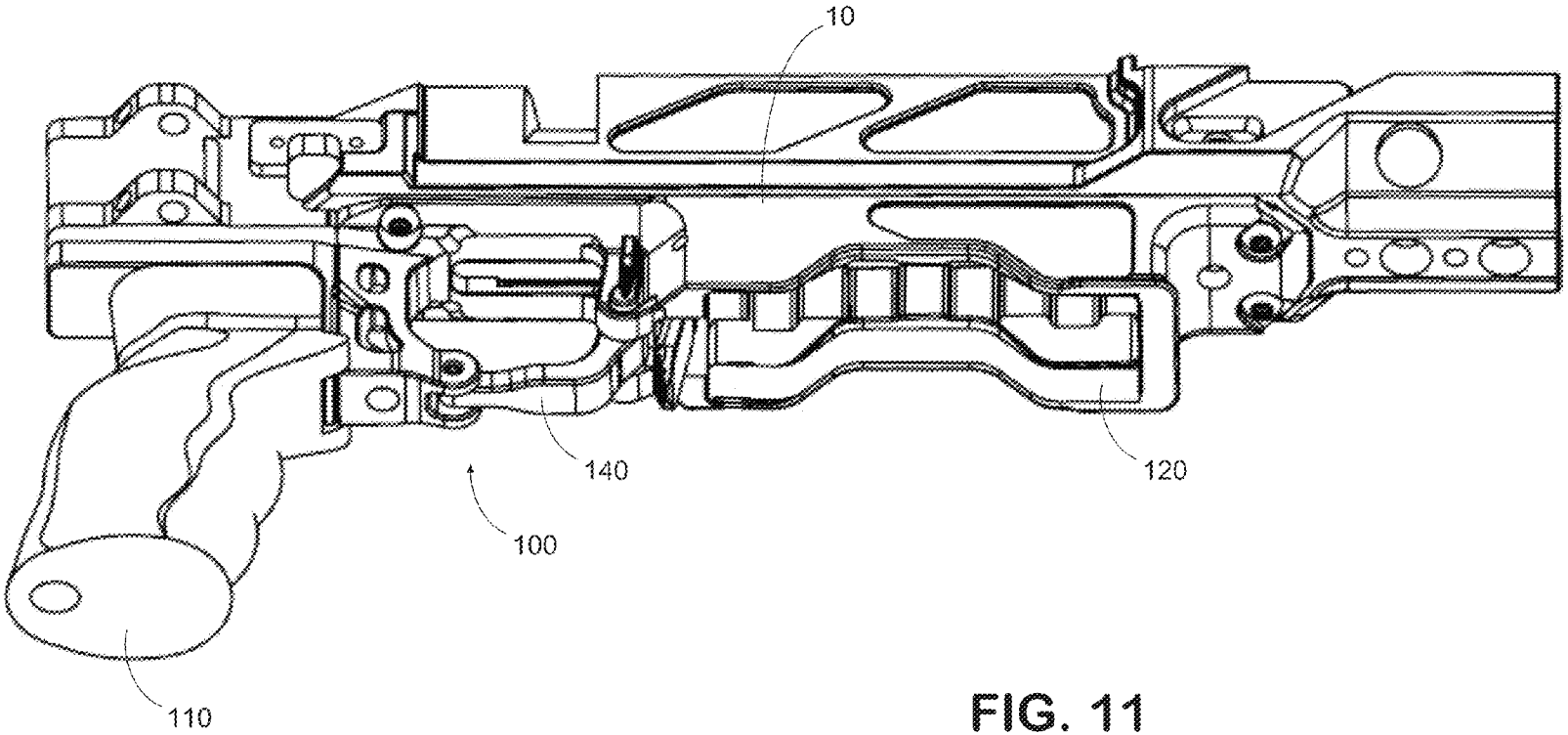
FIG. 11 is a perspective view of one aspect of a detachable chassis base for a firearm, showing sliding inserts to adjust the size of the magazine well opening.

FIG. 11 illustrates one aspect of the detachable chassis base where the trigger guard and magazine well are removable as an assembly to access the trigger mechanism for cleaning and/or maintenance and to access the inside of the chassis receiver from the bottom for cleaning. In this aspect, the magazine well employs an insert that is adjusted to accommodate different types and/or dimensions of magazines. The sliding inserts can be adjustable to enlarge or reduce the magazine well opening.

Figure 12:
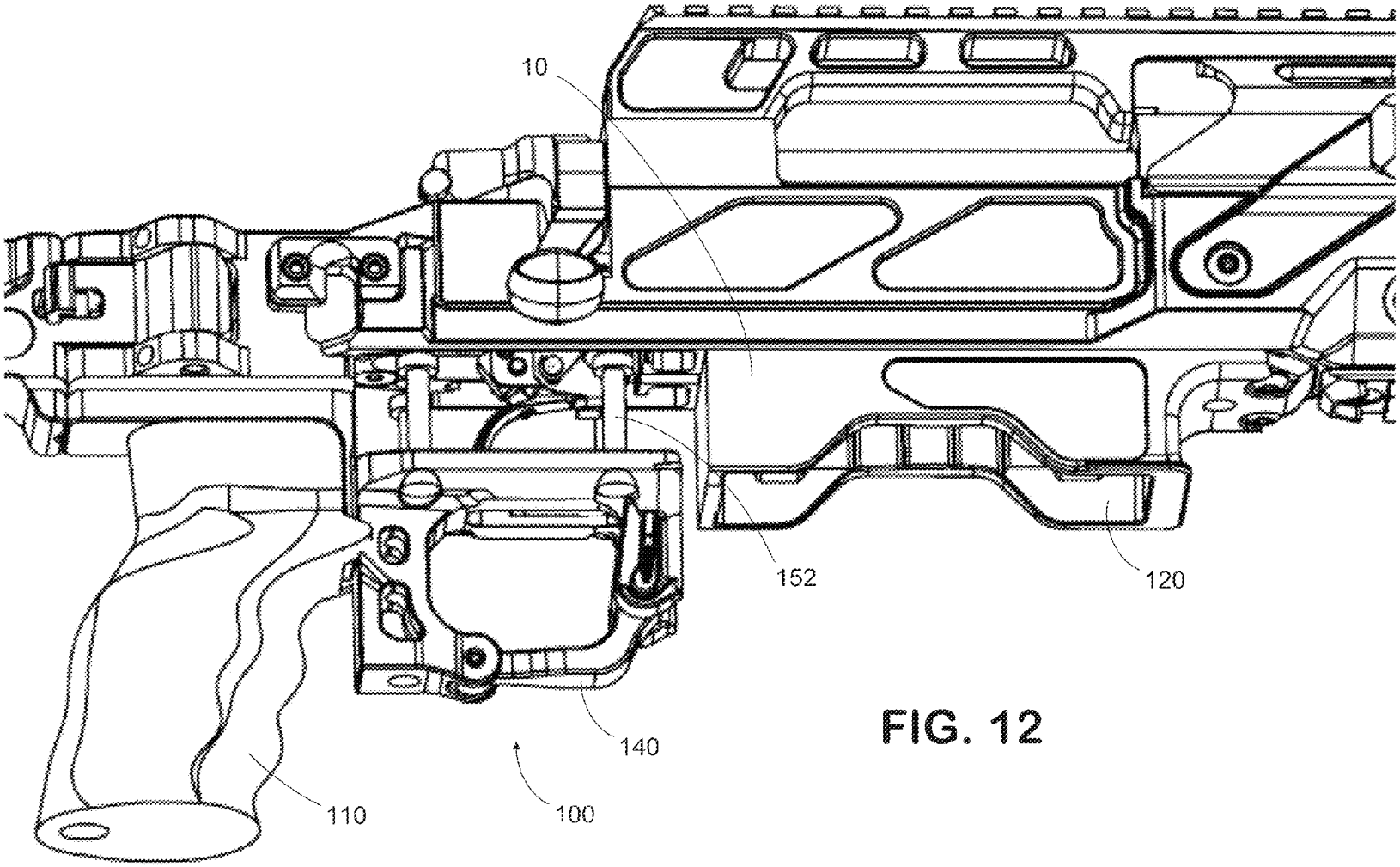
FIG. 12 is a perspective view of one aspect of a detachable chassis base for a firearm, showing sliding lock pins to secure the trigger guard to the chassis receiver.

FIG. 12 illustrates one aspect of the detachable chassis base 100 that uses sliding lock pins 152 to secure the trigger guard 140 to the chassis receiver 10. In this aspect, the trigger guard can slide downward but remain attached to the chassis receiver, to provide access to the trigger mechanism for cleaning and/or maintenance. Alternately, the detachable chassis base can include the magazine well 120 as part of the sliding base. The entire assembly can be removable for either greater access to trigger mechanism 15 and chassis receiver; or to exchange the detachable chassis base to accommodate other magazine sizes or types.

Figure 13:
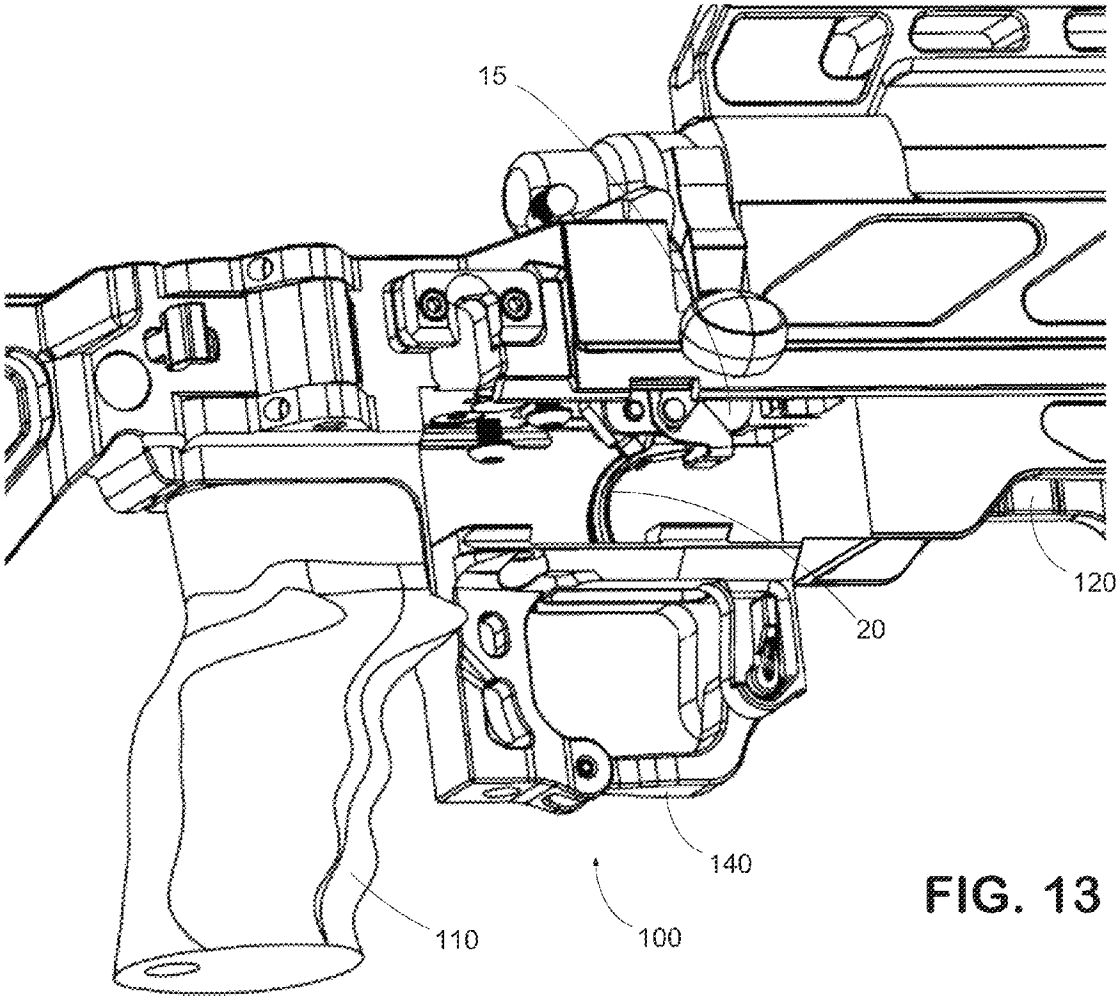
FIG. 13 is a perspective view of one aspect of a detachable chassis base for a firearm, showing sliding lugs on the detachable chassis base that interface with corresponding lugs on the receiver section of the chassis.

FIG. 13 illustrates one aspect of the detachable chassis base 100 comprising sliding lugs 154 on the detachable chassis base that interface with corresponding lugs 154 on the receiver. In this aspect, the trigger guard can be removed by loosening the retaining hardware and sliding the trigger guard 140 rearward to disengage the lugs. Alternately the sliding lug detachable chassis base can include the magazine well.

As mentioned herein above, multiple combinations of parts included in the detachable chassis base are possible. Several variations and combinations are illustrated herein, although others are contemplated.

Although several aspects of the invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described invention.

We claim:

1. A lower chassis assembly for a tactical rifle having a pistol grip, comprising:

a chassis receiver at least partially housing a barreled action;

a trigger mechanism at least partially housed within a portion of the chassis receiver, the trigger mechanism being connected to a trigger;

a detachable chassis base comprising a trigger guard, wherein the detachable chassis base is not directly connected to the barreled action and is configured to selectively move from a first position where the chassis base is attached to the chassis receiver such that the trigger guard substantially envelops the trigger and the trigger mechanism is substantially enclosed within the chassis receiver, to a second position where the chassis base is substantially detached from the chassis receiver exposing the trigger mechanism and permitting maintenance and adjustment of the same, and wherein the barreled action remains unaffected by detaching the chassis base enabling firing of the tactical rifle with the chassis base detached, wherein, in the first position, the detachable chassis base engages a portion of the pistol grip.

2. The lower chassis assembly of claim 1, wherein the detachable chassis base further comprises the pistol grip such that the pistol grip moves with the detachable chassis base from the first position to the second position.

3. The lower chassis assembly of claims 1 or 2, wherein the detachable chassis base further comprises a magazine well.

4. The lower chassis assembly of claim 3, wherein the detachable chassis base is an integral unit.

5. The lower chassis assembly of claim 3, further comprising a magazine sleeve configured for complimentary receipt within the magazine well.

6. The lower chassis assembly of claim 3, further comprising a magazine block configured for complimentary receipt within the magazine well.

7. The lower chassis assembly of claim 1, wherein the detachable base secured in the first position with at least one fastener.

8. The lower chassis assembly of claim 7, wherein the at least one fastener comprises a mounting screw.

9. The lower chassis assembly of claim 1, wherein the tactical rifle is a bolt action rifle.

10. The lower chassis assembly of claim 1, wherein a side portion of the detachable base is selectively removable.

11. A lower chassis assembly for a tactical rifle, comprising:

a chassis receiver at least partially housing a barreled action;

a trigger mechanism at least partially housed within a portion of the chassis receiver, the trigger mechanism being connected to a trigger;

a detachable chassis base comprising a trigger guard, the detachable chassis base being hingedly connected to a portion of the chassis receiver, wherein the detachable chassis bases is configured to selectively move from a first position where the chassis base is attached to the chassis receiver such that the trigger guard substantially envelops the trigger and the trigger mechanism is substantially enclosed within the chassis receiver, to a second position where the chassis base hinges away from the chassis receiver exposing the trigger mechanism and permitting maintenance and adjustment of the same, and wherein the barreled action remains unaffected by detaching the chassis base enabling firing of the tactical rifle with the chassis base detached.

12. The lower chassis assembly of claim 11, further comprising a pivot pin having a pivot axis, wherein the detachable chassis base hinges away from the chassis receiver along the pivot axis.

13. The lower chassis assembly of claim 12, wherein the pivot pin is positioned along a longitudinal side of the detachable chassis.

14. The lower chassis assembly of claim 12, wherein the pivot pin is positioned along a front end of the detachable chassis.

15. The lower chassis assembly of claim 12, wherein the pivot pin is positioned along a rear end of the detachable chassis.

16. The lower chassis assembly of claim 11, wherein the detachable chassis base further comprises a pistol grip.

17. The lower chassis assembly of claims 11 or 16, wherein the detachable chassis base further comprises a magazine well.

18. The lower chassis assembly of claim 17, wherein the detachable chassis base is an integral unit.

19. The lower chassis assembly of claim 17, further comprising a magazine sleeve configured for complimentary receipt within the magazine well.

20. The lower chassis assembly of claim 17, further comprising a magazine block configured for complimentary receipt within the magazine well.

21. The lower chassis assembly of claim 11, wherein the detachable base secured in the first position with at least one fastener.

22. The lower chassis assembly of claim 21, wherein the at least one fastener comprises a mounting screw.

23. The lower chassis assembly of claim 11, wherein the tactical rifle is a bolt action rifle.

* * * * *